US007676871B1

(12) United States Patent
Leach

(10) Patent No.: US 7,676,871 B1
(45) Date of Patent: Mar. 16, 2010

(54) PILLOW ASSEMBLY WITH ADJUSTABLE GIRTH AND ELASTIC CENTER PANEL

(76) Inventor: Jamie S. Leach, P.O. Box 717, Ada, OK (US) 74821-0717

( * ) Notice: Subject to any disclaimer, the term of this patent is extended or adjusted under 35 U.S.C. 154(b) by 64 days.

(21) Appl. No.: 12/060,981

(22) Filed: Apr. 2, 2008

(51) Int. Cl.
*A47C 16/00* (2006.01)
*A47D 13/00* (2006.01)

(52) U.S. Cl. ..... 5/655; 5/657; 5/653

(58) Field of Classification Search ..... 5/636, 5/640, 652, 652.1, 653, 655, 657
See application file for complete search history.

(56) References Cited

U.S. PATENT DOCUMENTS

| | | | | | |
|---|---|---|---|---|---|
| 909,453 | A | | 1/1909 | Pullman | |
| 2,626,407 | A | | 1/1953 | Kurry | |
| 3,312,987 | A | * | 4/1967 | Emery | 5/644 |
| 3,583,765 | A | | 6/1971 | Wallis | |
| 3,902,456 | A | | 9/1975 | David | |
| D282,427 | S | | 2/1986 | O'Sullivan | |
| 4,617,691 | A | * | 10/1986 | Monti et al. | 5/640 |
| 4,788,726 | A | | 12/1988 | Rafalko | |
| 4,834,459 | A | | 5/1989 | Leach | |
| 4,861,109 | A | | 8/1989 | Leach | |
| D309,018 | S | | 7/1990 | Leach | |
| 4,980,937 | A | | 1/1991 | Mason et al. | |
| 5,088,141 | A | | 2/1992 | Meyer et al. | |
| 5,103,514 | A | | 4/1992 | Leach | |
| 5,279,237 | A | | 1/1994 | Alivizatos | |
| 5,325,818 | A | | 7/1994 | Leach | |
| 5,363,524 | A | | 11/1994 | Lang | |
| 5,455,973 | A | | 10/1995 | Brumfield et al. | |
| 5,519,906 | A | * | 5/1996 | Fanto-Chan | 5/631 |
| 5,581,833 | A | * | 12/1996 | Zenoff | 5/655 |
| 5,813,066 | A | * | 9/1998 | Gebhard et al. | 5/655 |
| 5,822,817 | A | | 10/1998 | Carew et al. | |
| 5,839,138 | A | | 11/1998 | Weidman et al. | |
| 5,930,854 | A | | 8/1999 | O'Neill et al. | |
| 6,026,525 | A | | 2/2000 | Davis | |
| 6,079,067 | A | | 6/2000 | Becker et al. | |
| 6,141,807 | A | * | 11/2000 | Tapper | 5/653 |
| 6,343,727 | B1 | | 2/2002 | Leach | |
| 6,408,463 | B1 | | 6/2002 | Palacio | |
| 6,427,251 | B1 | | 8/2002 | Leach | |
| 6,463,608 | B1 | * | 10/2002 | Moe | 5/646 |

(Continued)

OTHER PUBLICATIONS

The "Tuckie Duckie" product shown in the web page (Exhibit A) from http://www.leachco.com published by Leachco, Inc. (Ada, OK, USA) on May 23, 2009, was in public use and/or on sale at least since about Jun. 2005.

(Continued)

*Primary Examiner*—Michael Trettel
(74) *Attorney, Agent, or Firm*—Mary M. Lee

(57) ABSTRACT

A pillow assembly with an elastic center panel and an adjustable girth. The pillow assembly comprises a C-shaped or ring-shaped pillow body and a pillow cover. The cover defines a continuous, generally tubular, ring-shaped enclosure sized to receive the pillow body. The pillow body defines a well, and the cover preferably includes a center panel that spans the well and forms a seat area. A cinch assembly on the front of the pillow cover allows the overall girth of the pillow assembly to be adjusted.

23 Claims, 7 Drawing Sheets

U.S. PATENT DOCUMENTS

| | | | | |
|---|---|---|---|---|
| 6,499,164 | B1 | 12/2002 | Leach | |
| 6,553,590 | B1 | 4/2003 | Leach | |
| 6,601,252 | B1 | 8/2003 | Leach | |
| 6,625,828 | B2 | 9/2003 | Matthews Brown | |
| 6,751,817 | B1 | 6/2004 | Leach | |
| 6,760,934 | B1 | 7/2004 | Leach | |
| 6,857,150 | B2 * | 2/2005 | Matthews Brown et al. .... | 5/655 |
| D503,063 | S | 3/2005 | Bartle et al. | |
| 7,000,275 | B2 * | 2/2006 | Matthews Brown et al. .... | 5/655 |
| 7,010,821 | B1 | 3/2006 | Leach | |
| 7,114,206 | B2 | 10/2006 | Leach | |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 2005/0278864 | A1 | 12/2005 | Leach | |
| 2006/0236461 | A1 | 10/2006 | Ryan | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0204402 | A1 | 9/2007 | Harris et al. | |
| 2007/0277321 | A1 | 12/2007 | Leach | |

OTHER PUBLICATIONS

The "Bath 'N Bumper" product shown in the web page (Exhibit B) from http://www.leachco.com published by Leachco, Inc. (Ada, OK, USA) on Jan. 28, 2008,was in public use and/or on sale at least since about Aug. 1999.

The "Wee Sleep" product shown in the web page (Exhibit C) from http://www.leachco.com published by Leachco, Inc. (Ada, OK, USA) on May 17, 2007, was in public use and/or on sale at least since about Aug. 2000.

The "Baby go Round" product shown in the web page (Exhibit D) from http://www.leachco.com published by Leachco, Inc. (Ada, OK, USA) on May 26, 2009, was in public use and/or on sale at least since about Aug. 1991.

The "Two by You" product shown in the web page (Exhibit E) from http://www.leachco.com published by Leachco, Inc. (Ada, OK, USA) on Jun. 19, 2008, was in public use and/or on sale since about to Oct. 2005.

The "Safer Bather" product shown in the web page (Exhibit F) from http://www.leachco.com published by Leachco, Inc. (Ada, OK, USA) on Jun. 25, 2009, was in public use and/or on sale since about Jul. 1994.

The "Safer Bather II" product shown on the catalog page (Exhibit G) from http://www.leachco.com published by Leachco, Inc. (Ada, OK, USA) in 2006, was in public use and/or on sale since about Nov. 1996.

The "Tot Pod" product shown in the packaging insert (Exhibit H) published by Leachco, Inc. (Ada, OK, USA) in Dec. 2007, was in public use and/or on sale since about Dec. 2007.

The "Boppy" product shown in the web page (Exhibit I) from http://www.target.com published by Target Stores on or before Jun. 25, 2009, was in public use prior to the filing date of this application, that is, prior to Apr. 2, 2008.

The "Boppy Newborn Lounger" product shown in the web page (Exhibit J) from http://www.target.com published by Target Stores on or before Jan. 9, 2008, was in public use prior to the filing date of this application, that is, prior to Apr. 2, 2008.

* cited by examiner

PILLOW ASSEMBLY WITH ADJUSTABLE GIRTH AND ELASTIC CENTER PANEL

FIELD OF THE INVENTION

The present invention relates generally to pillows and, more particularly but without limitation, to infant support pillows.

BACKGROUND OF THE INVENTION

Infant support pillow have become a staple of the modern nursery. They are lightweight, washable and serve many functions. Toroidal or "doughnut" shaped pillows, which provide a complete circle or bolster pillow with a completely enclosed center well, are ideal from newborn and premature infants. There remains a need, however, for infant support pillows with more versatility. Specifically, there is a need for an infant support pillow with an elastic center panel for supporting the tiny infant above the underlying surface while comfortably cradling him. In addition, there is a need for a pillow with an adjustable girth to accommodate different uses and positions of the infant as well as the increasing size of the infant as he grows.

DETAILED DESCRIPTION OF THE PREFERRED EMBODIMENT(S)

Figure 1:
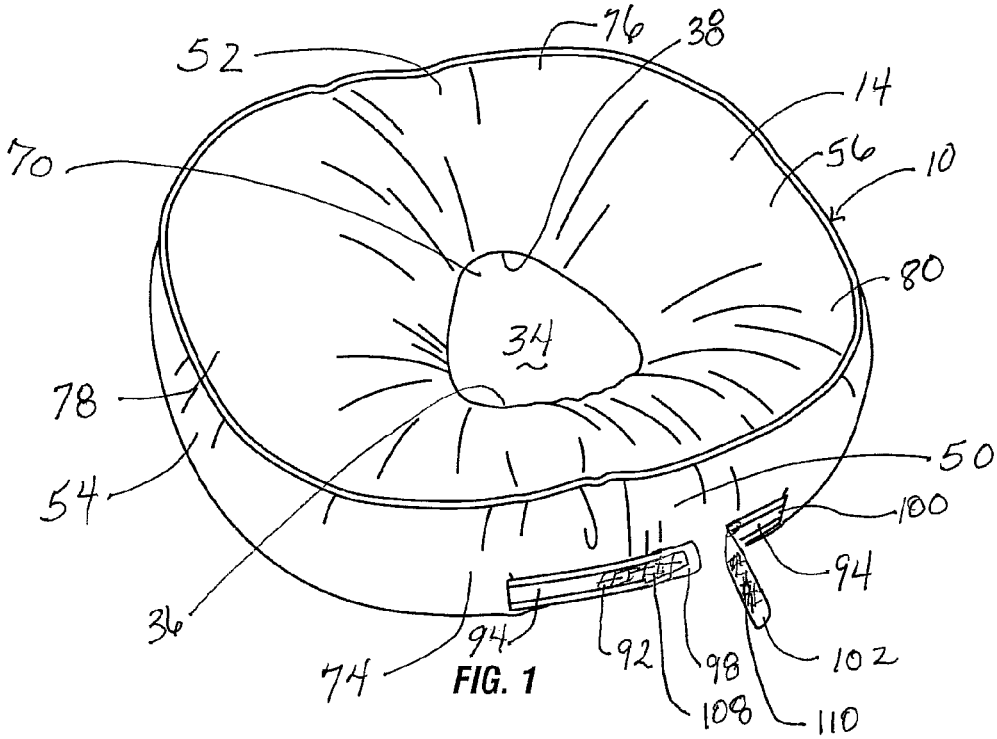
FIG. 1 is a frontal perspective view of a pillow assembly made in accordance with a preferred embodiment of the present invention.

Turning now to the drawings in general and to FIGS. 1-6 in particular, there is shown therein a pillow assembly made in accordance with a preferred embodiment of the present invention and designated generally by the reference numeral 10. The pillow assembly 10 preferably comprises a pillow body 12 contained within a pillow cover 14.

Figure 2:
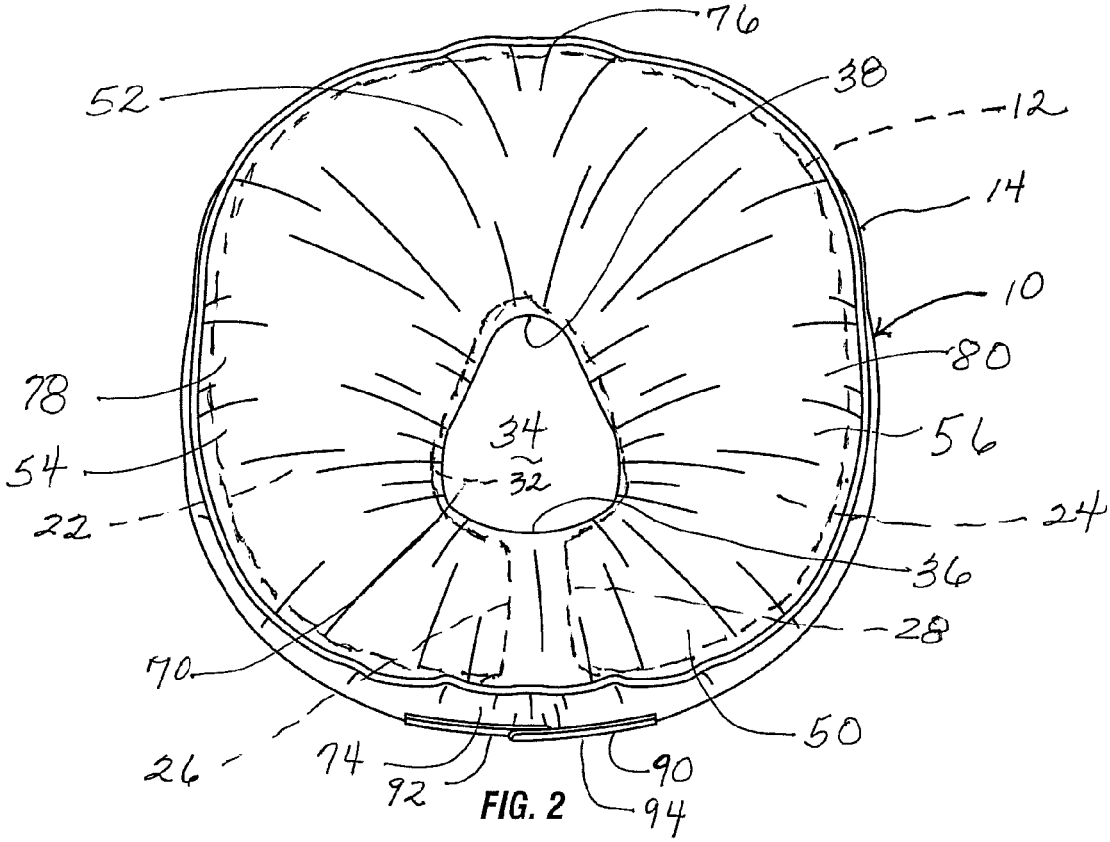
FIG. 2 is a plan view of the pillow assembly shown in FIG. 1. The relative size and shape of the pillow body inside the pillow cover is shown in broken lines.
Figure 6:
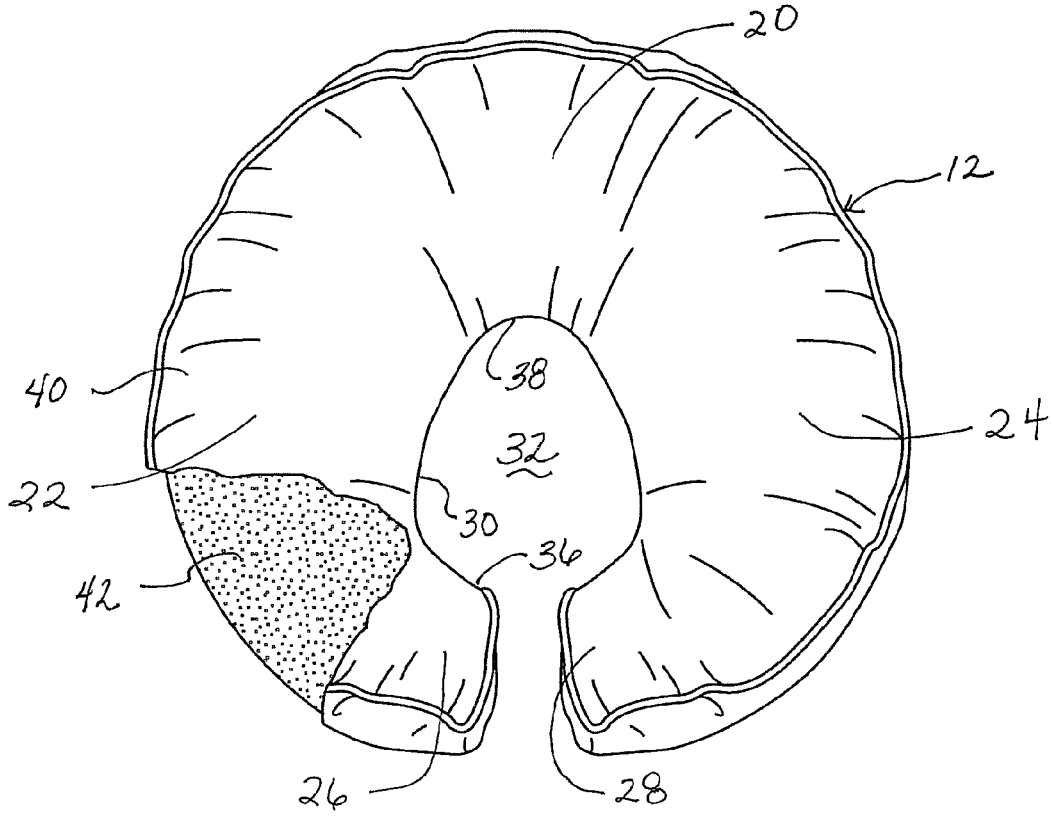
FIG. 6 is a plan view of the C-shaped pillow body of the pillow assembly.

As seen best in FIGS. 2 and 6, in a particularly preferred embodiment, the pillow body 12 is generally C-shaped comprising a center section 20 and a pair of curved arms 22 and 24. The arms 22 and 24 terminate in opposing blunt ends 26 and 28. The inner periphery 30 of the pillow body 12 forms an opening or well 32 (FIG. 6) corresponding to a seat are 34 in the pillow assembly 10 for receiving the body of an infant, as will be described hereafter.

As shown best in FIGS. 1 and 2, the shape of the well 32 in pillow assembly 10 preferably is generally triangular or teardrop shaped, having a broader base portion 36 and a narrower top portion 38. Most preferably, the top portion 38 extends toward the center section 20 of the pillow body 12 (FIG. 6) and the rear 52 of the pillow assembly 10 (FIGS. 1&2). Alternately, the well 32 and seat area 34 could be oval, round, polygonal or some other shape.

The pillow body 12 preferably is formed by first sewing a fabric enclosure 40 (FIG. 6) in the desired configuration. The enclosure material may be any suitable fabric, including but not limited to waterproof nylon, flannel, or elastic fabrics, such as spandex or cotton-spandex blends. However, presently a polyester/cotton blend is preferred. The enclosure 40 is filled with a compressible, resilient material 42. The enclosure 40 may or may not contain an opening through which the filler material 42 may be accessed, supplemented or replaced, which also permits laundering of the enclosure itself.

A preferred filler 42 for the pillow body 12 is polyester fiberfill, a loose filler than can be blown into the fabric enclosure 40 (or directly into the cover 14). Other suitable loose fillers that can be blown, poured or stuffed into the fabric enclosure 40 (or directly into the cover 14) include down feathers and polystyrene pellets. Alternately, a solid body of memory foam or some other solid compressible material may be employed. In some instances, an inflatable inner liner may be preferred. This construction provides a continuous, compressible and resilient pillow body 12, which can be deformed and reconfigured but will resume its original, resting shape when pressure is released.

In the resting position, shown in FIGS. 2 and 6, the ends 26 and 28 of the pillow body 12 preferably are spaced a distance apart for a reason that will become apparent. As used herein, "resting position" refers to the position and shape the pillow body 12, or pillow assembly 10, naturally assumes when no tension or pressure is exerted on any part of it.

With continuing reference to FIGS. 1-6, the pillow cover 14 is configured to define a continuous, generally toroidal-shaped enclosure. That is, the space inside the cover 14 is an endless, tubular ring forming a complete side wall 44 (FIGS. 11-14) around the seat area 34 in the pillow assembly 10. The pillow cover 14 has a front 50, a rear 52, and a pair of sides 54 and 56 extending therebetween.

It should be understood that "toroidal," as used herein, is not limited to a circular configuration. Rather the pillow cover 14 may form an oval, a square or other polygonal shape.

Similarly, though a generally circular cross-sectional shape is preferred, it is not essential. For example, the cross-sectional shape of the pillow cover enclosure may be oval, square or some other polygonal shape. Still further, steroidal does not require that the cross-sectional diameter of the pillow be the same around the entire circumference.

Of course, though the shape of the pillow body 12 and the pillow cover 14 may vary, the pillow cover should be sized to receive the pillow body. More specifically, the pillow cover 14 should be configured so that the blunt ends 26 and 28 of the pillow body 12 are positionable in the front 50 of the cover. Where the arms 22 and 24 are shaped so that the ends 26 and 28 are spaced a distance apart, this space preferably is roughly centered in the front 50 of the pillow cover 14, as best shown in FIG. 2. The center section 20 of the pillow body is positioned in the rear 52 of the pillow cover 14, and the arms 22 and 24 are received in the sides 54 and 56 of the cover.

Figure 4:
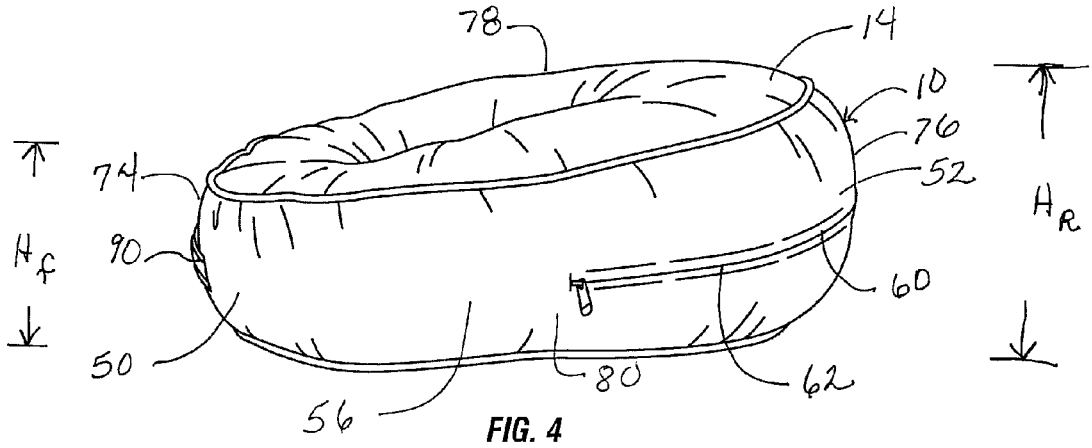
FIG. 4 is a side elevational view of the pillow assembly of FIG. 1.
Figure 5:
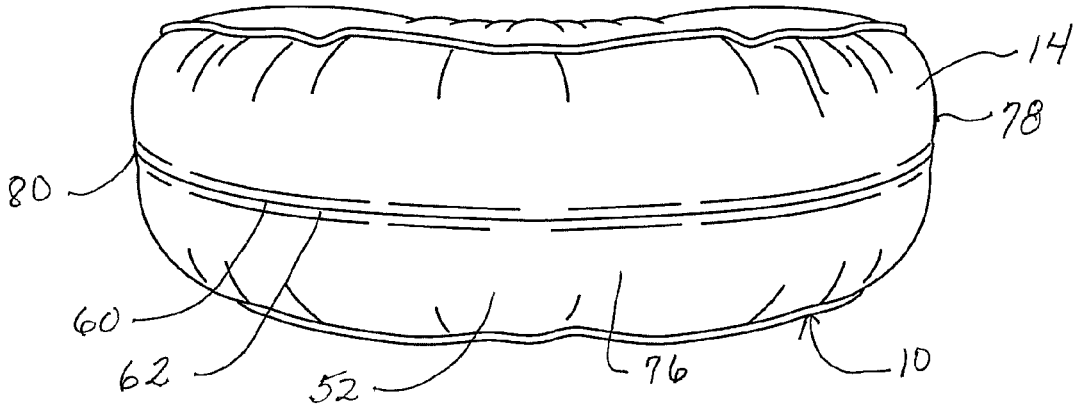
FIG. 5 is a rear elevational view of the pillow assembly of FIG. 1.

The pillow cover 14 may be formed from any of a variety of fabrics, but usually will be washable and durable. To that end, the cover 14 should also be designed so that the pillow body 12 can be easily removed and reinserted. For example, the cover 14 preferably is provided with an elongate opening 60 usually in the rear 52 (FIGS. 4&5). The size and location of the opening 60 may vary. Additionally, the opening 60 may or may not be provided with a closure mechanism, such as buttons, snaps, hook and loop connectors, or simply overlapping edges. However, a zippered closure 62 is much preferred.

With continued reference to FIGS. 1-6, the pillow cover 14 most preferably further comprises a center panel 70 sized and positioned to extend across the well 32 formed by the pillow body 12 when the pillow body is positioned inside the cover and defining the bottom of the seat area 34 in the pillow assembly 10. In preferred construction method, the pillow cover 14 is made from two similarly shaped pieces of fabric sewn together around their inner and outer peripheries, leaving the opening 60 for the zipper 62. The center panel 70 conveniently may be sewn into the seam of the inner periphery, as illustrated herein. It will be appreciated that in most instances the shape and size of the center panel 70 will conform closely to the shape of the well 32 formed by the pillow body 12. Thus, in the embodiment shown herein, the center panel 70 is teardrop shaped.

It is particularly preferred, though not required, that the center panel 70 be formed of an elastic material, more preferably a soft, lightweight fabric that provides freedom of movement and good shape retention. As used herein, "elastic material" means a fabric, such as spandex (elastane) or a spandex blend, which can be stretched repeatedly and still recover to its original length. Suitable elastic fabrics include, but are not limited to, Lycra brand spandex and spandex blends, such as twenty-five percent (25%) Lycra and seventy-five percent (75%) cotton.

It will now be apparent that, when the pillow body 12 is received in the pillow cover 14, the completed pillow assembly 10, as seen in FIGS. 1-5, has a front 74, a rear 76, and two side sections 78 and 80 extending therebetween, corresponding generally to the front 50, rear 52, and sides 54, 56 of the pillow cover 14. Similarly, the seat area 34 of the pillow assembly 10 corresponds to the well 32 of the body 12 and the center panel 70 of the cover 14 spanning it.

As illustrated in FIG. 4, in the preferred embodiment, the pillow assembly 10 is configured so that the height "$H_r$" of the rear 76 is greater than the height ""$H_f$" of the front 74. In other words, the overall front to back profile of the pillow assembly 10, when viewed from the side (FIG. 4), is gently sloped upwards. That is, the cross-sectional diameter of pillow body 12 gradually decreases from the center section 20 (FIG. 6) down to the ends 26 and 28 of the arms 2 and 24. (See FIGS. 11&12) This is desirable as it provides a comfortable reclining position for the infant when his bottom is positioned in the seat area 34. (See FIGS. 9&10)

Referring still to FIGS. 1-6 and directing attention now also to FIGS. 7 and 8, the girth adjustment feature of the pillow assembly 10 will be described. As indicated above, it is desirable to have a pillow that can be adjusted to the size of the infant as he grows. Similarly, a preferred girth adjustment feature also will allow the pillow assembly 10 to be cinched in or released to increase or decrease the depth and diameter of the seat area 34.

Figure 7:
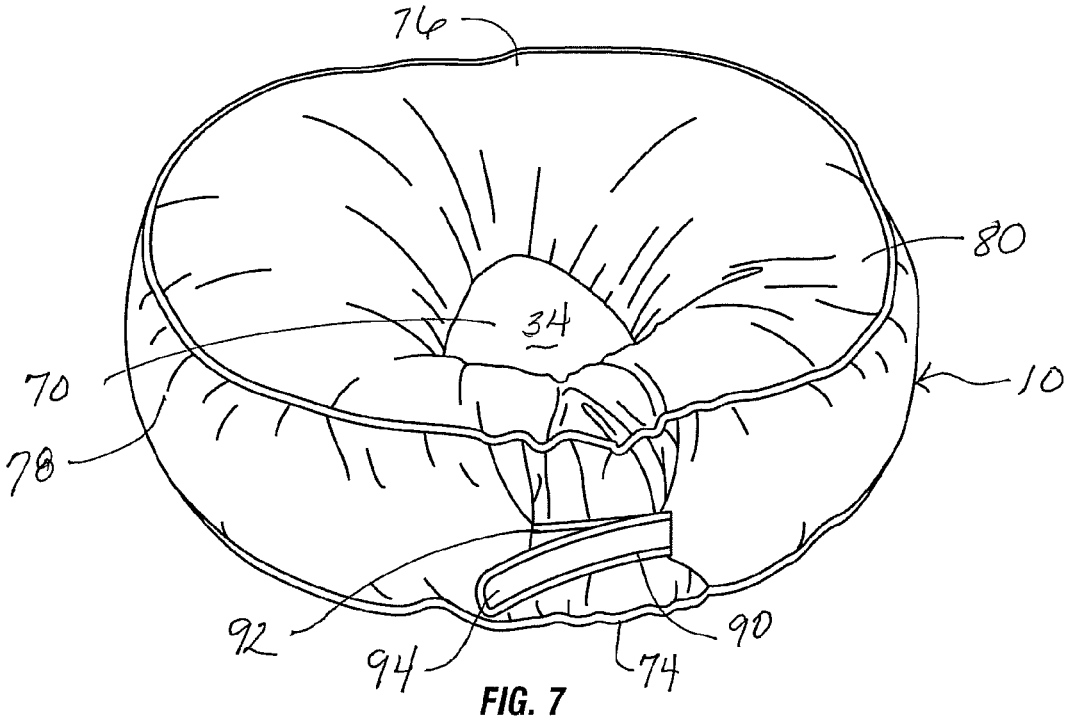
FIG. 7 is perspective view of the pillow assembly with the cinch assembly in a cinched position to narrow the girth of the pillow assembly.
Figure 8:
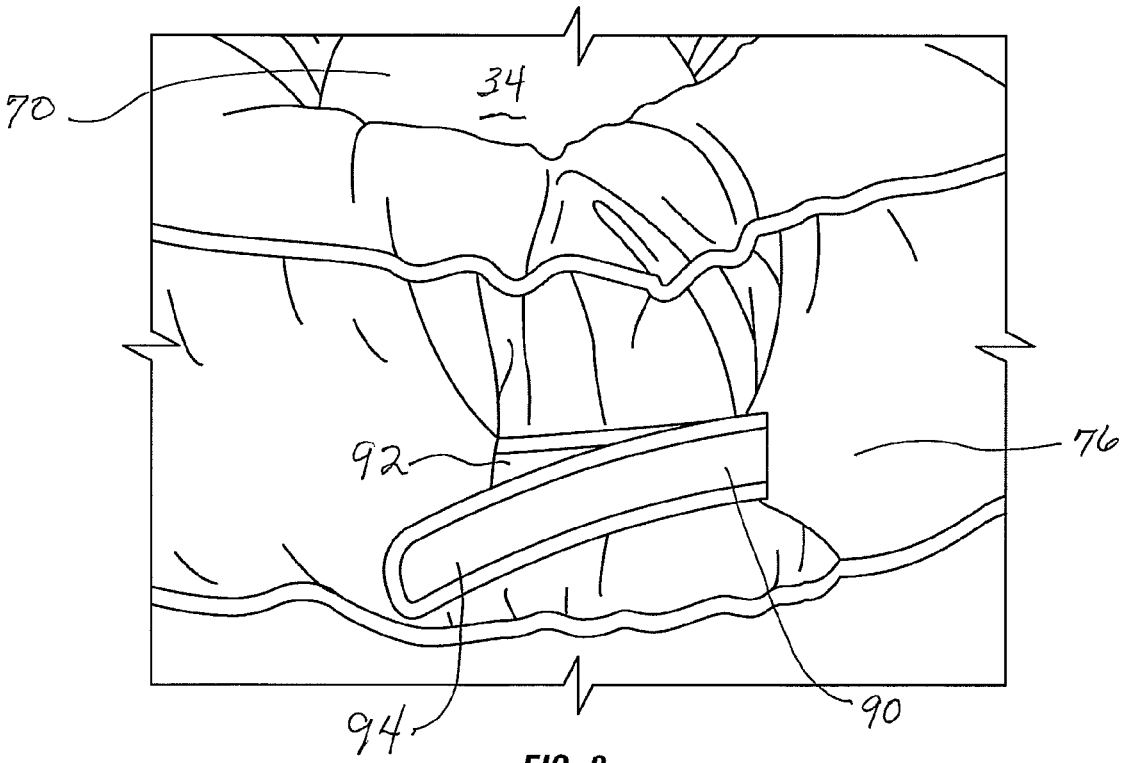
FIG. 8 is an enlarged, fragmented view of the cinched pillow assembly shown in FIG. 7.

To that end, the pillow assembly 10 includes a cinch assembly 90 that is configured to permit the girth of the pillow assembly to be adjusted by pulling the blunt ends 26 and 28 of the pillow body 12 closer to each other inside the front 50 of the pillow cover 14, as best shown in FIGS. 7 and 8. Now it will be appreciated that the degree of adjustability will be determined to a significant extent by the space between the blunt ends 26 and 28 in the resting position (FIG. 2) and also by the compressibility of the filler material 42. Since these factors may be varied, so also may the size and configuration of the cinch assembly 90. Notably, even when the ends 26 and 28 are not spaced a distance apart, and when the pillow body 12 is a solid continuous ring, the compressibility of the pillow body allows sufficient girth adjustability.

In the embodiment shown herein, the cinch assembly 90 comprises hook-and-loop fasteners. More specifically, a preferred cinch assembly 90 comprises first and second straps 92 and 94. The first strap 92 has a first end 96 and a second end 98, and the second strap has a first end 100 and second end 102. (See FIGS. 1&3) The first ends 96 and 100 are attached to the front 50 of the cover 14 and spaced apart a distance so that the extent of overlap is adjustable, as seen in FIGS. 1-3, 7&8.

The second end 98 includes a first connector 108, and the second end 102 includes a second connector 110 adjustably engageable with the first connector to cinch in the girth of the pillow assembly 10. Preferably, the first connector 108 is a strip of hook-and-loop fastener and the second connector is a strip of mating hook-and-loop fastener. However, a wide assortment of other connectors may be substituted. For example, the connectors 108 and 110 could be hooks, buttons, or snaps. Alternately, the straps 92 and 94 could be replaced with a pair of ties.

Figure 3:
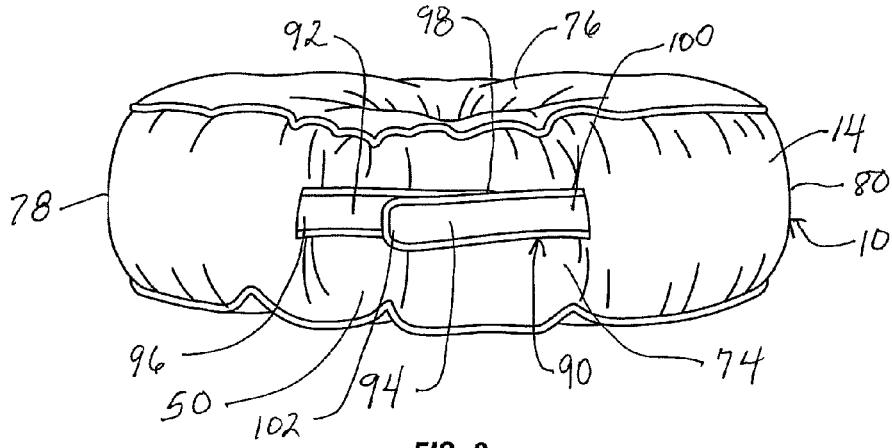
FIG. 3 is a front elevational view of the pillow assembly of FIG. 1.

FIGS. 1-3 show the cinch assembly 90 is a released mode allowing the pillow assembly to remain in its resting position with the ends 26 and 28 of the arms 22 and 24 spaced apart (FIG. 2). FIGS. 7 and 8 show the straps 92 and 94 in a cinched-in position, with greater overlap, reducing the girth of the pillow assembly 10. Although not shown in these figures, it will be appreciated that the ends 26 and 28 of the arms 22 and 24 have been brought into abutment with each other inside the cover 14.

Thus, the open, C-shaped configuration of the pillow body 12, including the curved arms 22 and 24 with the spaced apart ends 26 and 28, allows the girth to be easily reduced by pressing the arms together. On the other hand, though, the continuous tubular cover 14 provides a pillow assembly 10 with a closed, endless side wall **44*r* completely surrounding the seat area 34, regardless of the position of the cinch assembly 90**.

Figure 9:
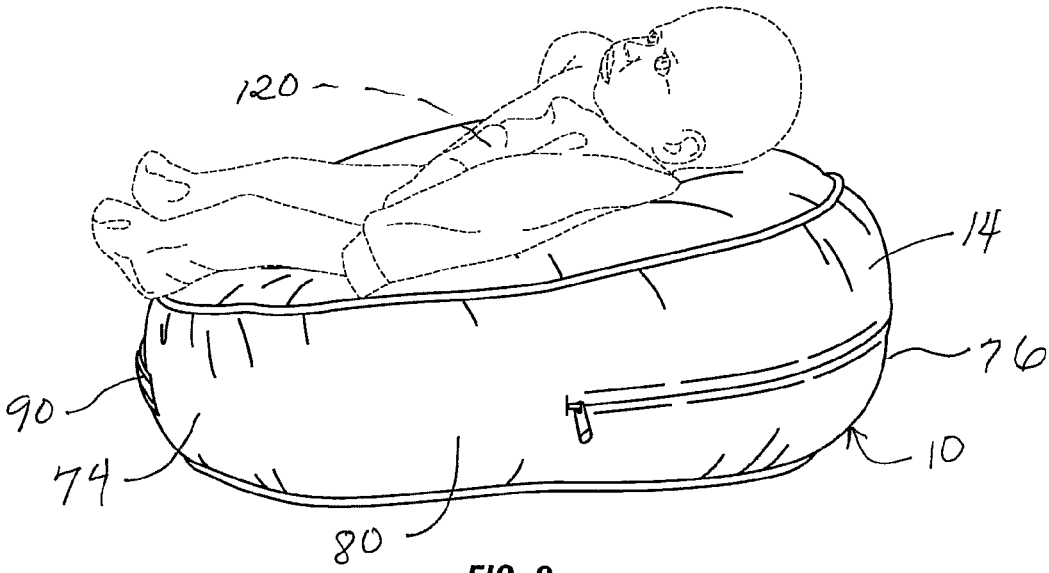
FIG. 9 is a side elevational view of the pillow assembly with an infant reclining therein, the infant being shown in broken lines.
Figure 10:
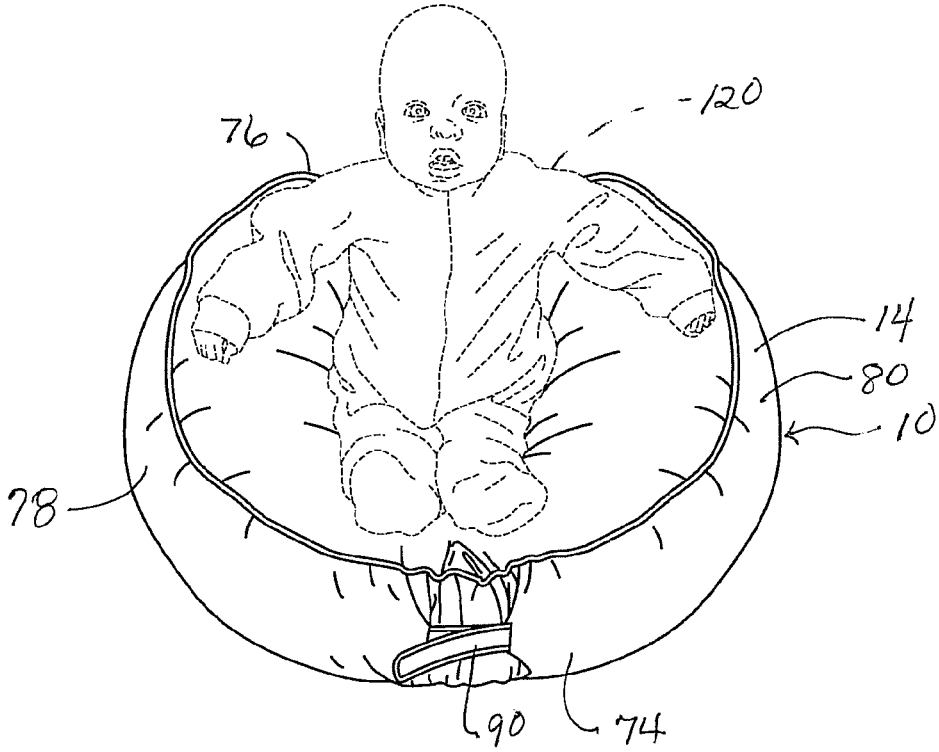
FIG. 10 is front perspective view of the pillow assembly with an infant seated nearly upright therein, the infant being shown in broken lines.

Turning now to FIGS. 9-14, the advantages of the elastic panel 70 will be explained more fully. As illustrated in FIGS. 9 and 10, the position of the infant 120, shown in broken lines, may be varied. In particular, the angle of the infant's back may lower, as in FIG. 9, or higher, as in FIG. 10. Additionally, though not shown in the drawings, the size and weight of the infant 120 may vary significantly.

Figure 11:
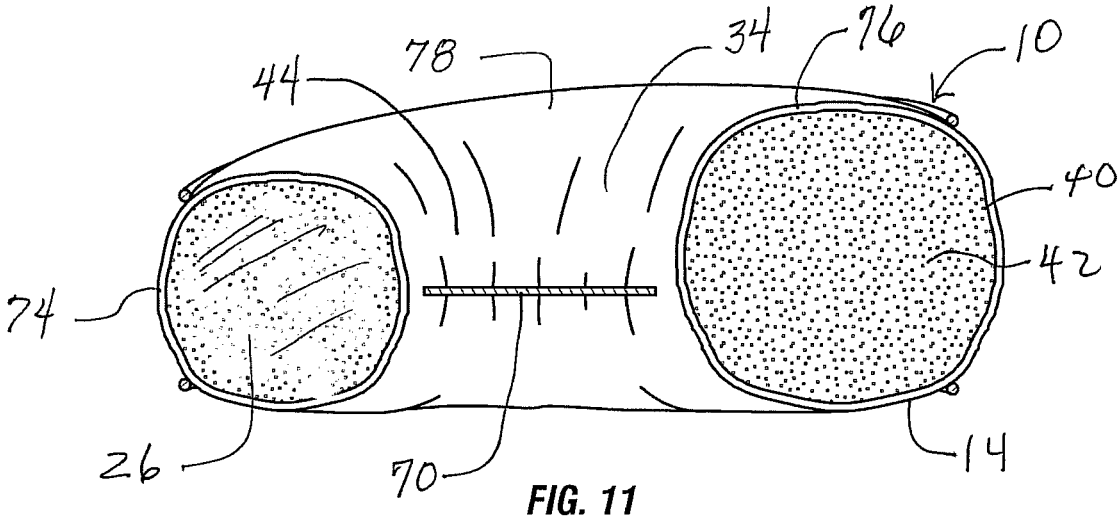
FIG. 11 a longitudinal sectional view of the pillow assembly in its resting position with the elastic panel unstretched.
Figure 12:
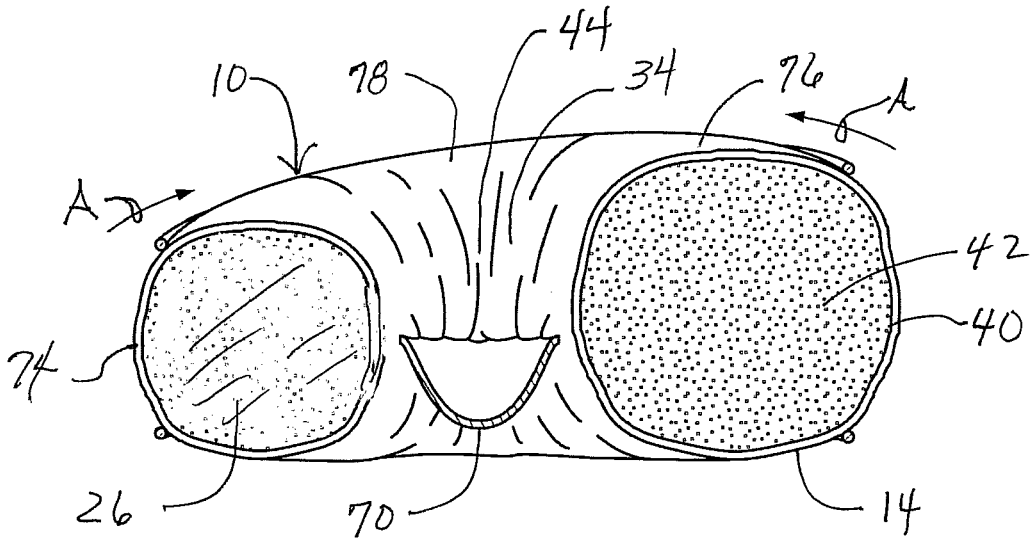
FIG. 12 is a longitudinal sectional view of the pillow assembly with the elastic panel pressed downwardly to illustrate the action of the pillow assembly as the baby's bottom sinks into the panel and shows how the pillow body is pulled in towards the center.
Figure 13:
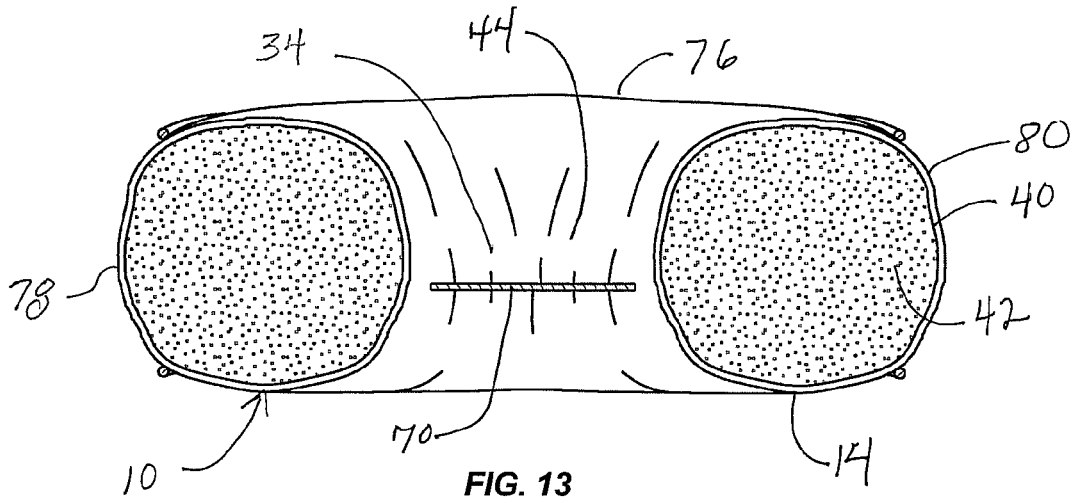
FIG. 13 a transverse sectional view of the pillow assembly in its resting position with the elastic panel relaxed or unstretched.
Figure 14:
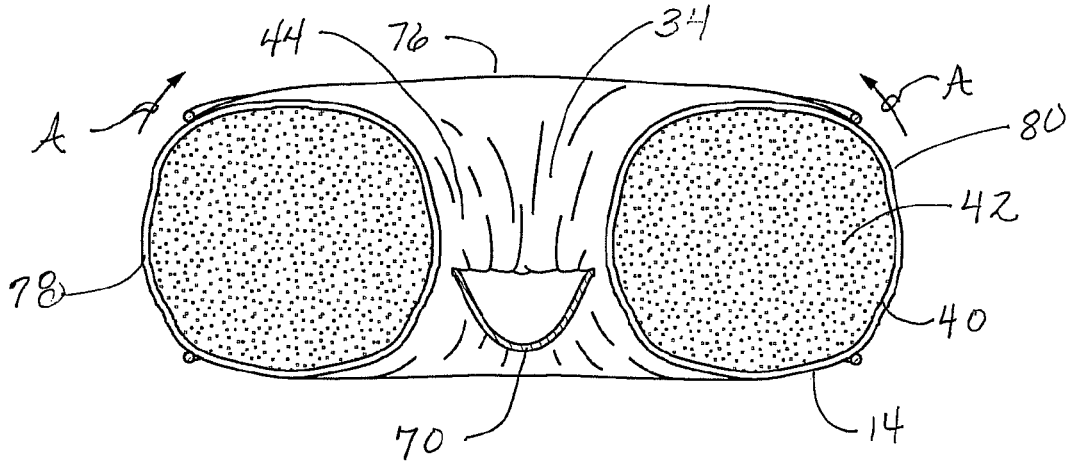
FIG. 14 is a transverse sectional view of the pillow assembly with the elastic panel pressed downwardly to illustrate the action of the pillow assembly as the baby's bottom sinks into the panel and shows how the pillow body is pulled in towards the center.

FIGS. 11-14 illustrate the effect of pressure on the center panel 70 and the pillow assembly 10. FIG. 11 shows a longitudinal (front to back) sectional view of the pillow assembly 10, and FIG. 13 shows a transverse (side-to-side) sectional view of the pillow assembly, both with the pillow assembly in its resting or relaxed position. FIGS. 12 and 14 show how the pillow assembly responds to pressure from the infant's body on the center panel 70. As seen in FIGS. 12 and 14, as the center panel 70 is pressed downwardly, the sides of the seat area 34 are pulled in slightly in the direction of the arrows "A." Thus, the infant 120 (FIG. 10) will sit more deeply in the seat area 34. On the other hand, if the infant is lighter, or more of his weight is distributed to the front 74 and rear 76 of the pillow assembly 10, the panel 70 is higher making the seat area 34 more shallow.

Now it will be understood that the cinch assembly 90, elasticity of the seat panel 70, and the configuration of the C-shaped pillow body 12 inside the circular cover 14, along with the selective positioning of the infant 120, all provide an infant support pillow with enhanced adjustability and versatility.

The elastic center panel 70 supports a newborn so that he is suspended slightly off the surface on which the pillow assembly is placed. The weight of his body slightly deepens the seat area 34 so all of the sides come up and around his body, especially around his bottom and under the thighs, which help prevents the infant 120 from rolling or sliding out of position. An older, heavier infant sinks deeper into the elastic panel 70, providing a deeper seat area 34 to accommodate the larger infant. The larger infant can also sit upright because the weight of his body makes the rear 76 of the pillow assembly 10 rise up slightly behind his back providing all around support to help the infant maintain an upright or seated position.

Although not illustrated in the drawings, the pillow cover 14 may be reversible. To that ends, a cinch assembly 90 may be provided on both sides of the cover 14. In the reversible cover, the opposing sides of fabric may be different colors, textures or patterns.

In one alternate embodiment, the pillow body may be a solid, continuous ring of resilient, compressible material. That is, rather than being C-shaped with arms separated at their ends, the pillow body may be an endless ring. For example, the pillow body may simply be loose filing blown or otherwise inserted through an opening in the cover 14, such as the zippered opening 60 described herein.

While the preferred embodiment of the present invention provides an ideal infant support pillow, its use is not so limited. By enlarging the pillow, it is ideal for use by toddlers as a reading and lounging pillow. Still further, the inventive pillow alternately may be used as a bed for a pet, such as a cat or dog. When this is the intended use, it is advantageous to make the cover out of a rough, textured material. It is also often desirable to make the cover reversible with a cooler fabric for summer on one side, and warmer fabric on the other side for winter. These and other applications and uses for the pillow assembly of the present invention will be readily apparent.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow assembly comprising:

a generally C-shaped pillow body formed of compressible, resilient material and comprising a center section and a pair of curved arms terminating in opposing blunt ends, the inner periphery of the body forming a well;

a removable pillow cover defining a continuous, tubular ring-shaped enclosure with a front, a rear, and a pair of sides extending therebetween, the enclosure sized to receive the pillow body in its resting position and so that the blunt ends of the arms are positioned in the front of the cover and the center section of the pillow is positioned in the rear of the cover, the enclosure having an opening in the rear through which the pillow body is insertable into the pillow cover; and a cinch assembly positioned and configured to adjust the overall girth of the pillow assembly by pulling the blunt ends of the arms of the pillow body towards each other.

2. The pillow assembly of claim 1 wherein, when the pillow body is received in the pillow cover, the pillow assembly has a front and a rear and two side sections extending therebetween and the height of the rear is greater than the height of the front.

3. The pillow assembly of claim 2 wherein the pillow cover further comprises a center panel extending across well of the pillow body when the pillow body is enclosed in the cover.

4. The pillow assembly of claim 3 wherein the center panel is formed of an elastic material.

5. The pillow assembly of claim 3 wherein the well formed by the pillow body is teardrop shaped and wherein the center panel is generally teardrop shaped.

6. The pillow assembly of claim 5 wherein the center panel is formed of an elastic material.

7. The pillow assembly of claim 1 wherein the pillow is characterized by a cross-sectional diameter that gradually decreases from the center section to the ends of the arms.

8. The pillow assembly of claim 1 wherein the cinch assembly comprises:

a strap having a first end and a second end; and a second strap having a first end and a second end;

wherein the second end of the first strap comprises a first connector;

wherein the second end of the second strap comprises a second connector adjustable engagable with the first connector;

wherein the first ends of the first and second straps are attached to the front of the pillow cover and spaced a distance apart so that the second ends of the first and second straps may be adjustably connectable to cinch in the girth of the pillow assembly.

9. The pillow assembly of claim 8 wherein the first and second connectors are mating hook-and-loop fasteners.

10. The pillow assembly of claim 1 wherein the pillow cover further comprises a center panel extending across well of the pillow body when the pillow body is enclosed in the cover.

11. The pillow assembly of claim 10 wherein the center panel is formed of an elastic material.

12. The pillow assembly of claim 1 wherein the well formed by the pillow body is teardrop shaped and wherein the center panel is generally teardrop shaped.

13. The pillow assembly of claim 12 wherein the center panel is formed of an elastic material.

14. The pillow assembly of claim 1 wherein the opening in the rear of the pillow cover is zippered.

15. The pillow assembly of claim 1 wherein in the resting position the blunt ends of the arms are spaced a distance apart.

16. A pillow assembly comprising:

a pillow body comprising compressible, resilient material formed into an endless ring shape, the inner periphery of the body forming a well;

a pillow cover defining a continuous, tubular ring-shaped enclosure, the enclosure sized to receive the pillow body in its resting position, the enclosure having an opening through which the pillow body is insertable into the pillow cover, wherein the pillow cover further comprises a center panel extending across the well of the pillow body when the pillow body is enclosed in the cover, and wherein the center panel is formed of an elastic material; and a cinch assembly positioned and configured to adjust the overall girth of the pillow assembly.

17. The pillow assembly of claim 16 wherein the pillow assembly has a front and a rear and two side sections extending therebetween and the height of the rear is greater than the height of the front.

18. The pillow assembly of claim 16 wherein the well formed by the pillow body is teardrop shaped and wherein the center panel is generally teardrop shaped.

19. The pillow assembly of claim 16 wherein the pillow body is characterized by a cross-sectional diameter that gradually decreases from the rear to the front.

20. The pillow assembly of claim 16 wherein the cinch assembly comprises:

a strap having a first end and a second end; and a second strap having a first end and a second end;

wherein the second end of the first strap comprises a first connector;

wherein the second end of the second strap comprises a second connector adjustably engageable with the first connector;

wherein the first ends of the first and second straps are attached to the front of the pillow cover and spaced a distance apart so that the second ends of the first and second straps may be adjustably connectable to cinch in the girth of the pillow assembly.

21. The pillow assembly of claim 20 wherein the first and second connectors are mating hook-and-loop fasteners.

22. The pillow assembly of claim 16 wherein the opening in the pillow cover is zippered.

23. The pillow assembly of claim 16 wherein the pillow body comprises a loose filler that can be blown, poured or stuffed into the pillow cover.

* * * * *